US008584861B2

(12) United States Patent
Porath

(10) Patent No.: US 8,584,861 B2
(45) Date of Patent: Nov. 19, 2013

(54) PORTABLE GOLF SHAFT DISPLAY ASSEMBLY

(75) Inventor: Brett C. Porath, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 348 days.

(21) Appl. No.: 13/196,920

(22) Filed: Aug. 3, 2011

(65) Prior Publication Data

US 2013/0032557 A1 Feb. 7, 2013

(51) Int. Cl.
*B65D 85/00* (2006.01)
*A45F 3/02* (2006.01)

(52) U.S. Cl.
CPC ..... *B65D 85/70* (2013.01); *A45F 2200/0566* (2013.01)
USPC ..... 206/756; 206/315.2; 224/607; 224/617; 224/258; 211/70.2

(58) Field of Classification Search
USPC ..... 206/315.2, 315.3, 315.6, 736, 756; 224/601, 607, 616, 617, 251, 258; 211/64, 65, 68, 69, 70.2, 70.8, 195, 211/198
See application file for complete search history.

(56) References Cited

U.S. PATENT DOCUMENTS 1,437,349 A * 11/1922 Moore, Jr. ..... 206/315.6
1,442,906 A * 1/1923 Rawlings et al. ..... 206/315.4
1,597,870 A * 8/1926 Reach ..... 206/315.6
1,920,308 A * 8/1933 Hiles ..... 206/315.6
2,023,792 A * 12/1935 Sampson ..... 206/315.4
2,047,079 A * 7/1936 MacMurray ..... 224/613
2,070,254 A * 2/1937 Burgner ..... 211/70.2
2,471,169 A * 5/1949 Salzberg et al. ..... 206/315.4
2,507,249 A * 5/1950 Dorazio ..... 206/315.8
2,538,374 A * 1/1951 May ..... 280/645
2,595,987 A * 5/1952 Shears ..... 206/315.6
2,732,871 A * 1/1956 Drown ..... 224/674
2,854,775 A * 10/1958 Kleckley ..... 43/26
3,530,919 A * 9/1970 May ..... 206/315.4
3,575,327 A * 4/1971 Harrison ..... 294/149
3,779,297 A * 12/1973 Stammer ..... 206/315.6
3,829,092 A 8/1974 Arkin
3,848,737 A * 11/1974 Kenon ..... 206/315.2
3,896,981 A * 7/1975 Purple ..... 206/315.1
3,973,776 A * 8/1976 Ogle ..... 224/155
4,181,220 A 1/1980 Zicko
4,182,391 A * 1/1980 Kjose ..... 224/581
4,227,559 A * 10/1980 Stroman ..... 206/315.6
4,334,564 A * 6/1982 Clayton ..... 206/315.6
4,420,024 A * 12/1983 Clayton ..... 206/315.4
4,645,275 A 2/1987 Pucci (Continued)

*Primary Examiner* — Michael Safavi
(74) *Attorney, Agent, or Firm* — Troy R. Lester

(57) ABSTRACT

A display assembly, that is easily transported to a presentation site and can quickly and easily be converted from carrying mode to a free standing exhibit display of a plurality of golf club shafts. The display assembly comprises a canvas backdrop serving also as a carrying case. The backdrop having defined on an inner side a plurality of longitudinally friction fitted, aligned sleeves which hold and display a corresponding number of golf club shafts. By inserting three thin rods, which can be metal, wood or hard plastic such as polyurethane, into corresponding compartments and then pulling upward on a cloth handle, a free standing display is created. The supporting structure of the display is provided by a combination of the rods and the golf club shafts. Hook and loop straps wrap around and tightly contain the assembly when it is transported.

14 Claims, 7 Drawing Sheets

(56) References Cited

U.S. PATENT DOCUMENTS

| | | | | | |
|---|---|---|---|---|---|
| 4,651,872 | A | * | 3/1987 | Joyce | 206/760 |
| 4,655,354 | A | | 4/1987 | Cohen | |
| 4,682,691 | A | * | 7/1987 | Spiering | 206/373 |
| 5,117,724 | A | * | 6/1992 | Gardner | 84/421 |
| 5,248,030 | A | | 9/1993 | Tarozzi | |
| 5,327,669 | A | * | 7/1994 | Lannan et al. | 43/26 |
| 5,518,217 | A | | 5/1996 | Deutsch et al. | |
| 5,653,337 | A | * | 8/1997 | Cirigliano | 206/373 |
| 5,695,067 | A | * | 12/1997 | Harvey | 206/579 |
| D393,944 | S | | 5/1998 | Stowell | |
| 6,070,729 | A | * | 6/2000 | Barnes | 206/581 |
| 6,135,635 | A | * | 10/2000 | Miller et al. | 383/2 |
| 6,217,042 | B1 | * | 4/2001 | Kurtz et al. | 280/37 |
| 6,286,673 | B1 | * | 9/2001 | Robertson | 206/315.3 |
| 6,394,287 | B2 | * | 5/2002 | Cabrera | 211/70.2 |
| D458,743 | S | * | 6/2002 | Brookhouse | D3/206 |
| D459,071 | S | * | 6/2002 | Brookhouse | D3/206 |
| D466,686 | S | * | 12/2002 | Brookhouse | D3/206 |
| D476,811 | S | * | 7/2003 | Brookhouse | D3/299 |
| 6,629,601 | B1 | * | 10/2003 | Russell | 206/315.3 |
| 6,776,283 | B1 | | 8/2004 | Drexler | |
| 6,830,150 | B1 | * | 12/2004 | Cyr | 206/459.1 |
| D505,010 | S | * | 5/2005 | Russell | D3/255 |
| 7,040,899 | B2 | | 5/2006 | Armstrong | |
| 7,178,778 | B2 | | 2/2007 | Lee | |
| 7,278,539 | B2 | * | 10/2007 | Souza | 206/315.1 |
| 7,377,279 | B1 | * | 5/2008 | Malaspina | 128/870 |
| 7,455,178 | B2 | * | 11/2008 | Miller, Jr. | 206/315.1 |
| 7,934,596 | B1 | * | 5/2011 | Aycock | 206/45.24 |
| 8,028,833 | B1 | * | 10/2011 | Clark | 206/385 |
| 2001/0054595 | A1 | * | 12/2001 | Cabrera | 211/70.2 |
| 2006/0037877 | A1 | * | 2/2006 | Souza | 206/315.1 |
| 2006/0086768 | A1 | * | 4/2006 | Cotlong | 224/607 |
| 2007/0084811 | A1 | * | 4/2007 | Dolson et al. | 211/85.7 |
| 2008/0035523 | A1 | * | 2/2008 | Lemire | 206/774 |
| 2009/0178950 | A1 | * | 7/2009 | Quartarone et al. | 206/579 |
| 2010/0155276 | A1 | * | 6/2010 | King | 206/315.5 |
| 2010/0180993 | A1 | * | 7/2010 | Gilardi | 150/154 |

* cited by examiner

20

PORTABLE GOLF SHAFT DISPLAY ASSEMBLY

FIELD OF THE INVENTION

This invention is directed toward a display assembly, and more particularly a collapsible and portable display for the presentation of golf club shafts wherein it is the golf club shafts that provide most of the support for the free standing display.

BACKGROUND OF THE INVENTION

In the golfing industry, it is important that the club manufacturers are able to provide sizing or fitting of their golf clubs to the golfing public. Often this takes the form of fitting sessions, wherein a representative of the manufacturer visits preordained sites and conducts fittings to determine what specifications would be best suited for each individual golfer. Proper fitting of the clubs involves selecting clubhead properties such as model, center of gravity properties, lie angles, loft angles, and weights; shaft properties such as length, weight, tip stiffness, flex, and flex point. Of course it is hoped that the golfers will achieve better performance with their fitted clubs and purchase the manufacturers golf clubs, therefore these sessions are a very important step in the selling process.

Today, a golfer selecting a driver from Titleist®, has ten different shaft manufacturers to choose from, and some of these manufacturers have as many as twenty different specification options. First, a golfer must decide between steel and graphite. And then between flexes (Ladies, Seniors, Regular, Stiff, or X-Stiff), or weight (54 to 88 grams), or torque (which can range from 2.2° to 4.5°), or launch point (low, medium or high), and some golfers may prefer a shaft that is an inch shorter or longer. So, it is obvious that it is important for the manufacturer's representative to be able to carry with him and be able to present and display a large assortment of shafts with varying specifications.

Thus there is a need in the art for means to allow a manufacturer representative to carry with him/her a large sampling of golf club shafts in a very compact, portable and easily carried case, and most important one that is easy to set-up and display.

SUMMARY OF THE INVENTION

A portable golf shaft assembly for use in providing a display of golf club shafts comprising a canvas backdrop which also serves as the carrying case. The backdrop having defined on an inner side a plurality of longitudinally friction fitted, aligned sleeves which hold and display a corresponding number of golf club shafts. Each shaft in the display has a distal end that frictionally fits within the sleeve and a grip end that extends out of the sleeve for display.

The assembly has three longitudinal compartments, all three open at each end and extending the length of the canvas. Two of the compartments are defined on opposing sides of the backdrop and one compartment defined along the center. The user simply inserts one of three thin rods, which can be metal, wood or hard plastic such as polyurethane, into each compartment and then pulls upward with a cloth handle to create a free standing display, resembling a pup tent. The supporting structure of the display is provided by a combination of rods and golf club shafts.

One of the embodiments of the display assembly comprises two locking straps which function to encircle and secure the assembly when the assembly is broken down and ready for transporting. Also aiding in creating the display into a carrying case are three hook and loop fastener systems; two of the systems on opposing sides of the display, and the remaining one in parallel with the others and in the center of the assembly. They wrap around and tightly contain the assembly when being transported. When the assembly is in the display mode, the two hook and loop fasteners which are on opposing sides of the assembly, are utilized to provide a measure of support for the display.

One embodiment of the invention provides for an adjustable shoulder strap for aid in carrying the assembly.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DETAILED DESCRIPTION THE PREFERRED EMBODIMENT

Figure 1:
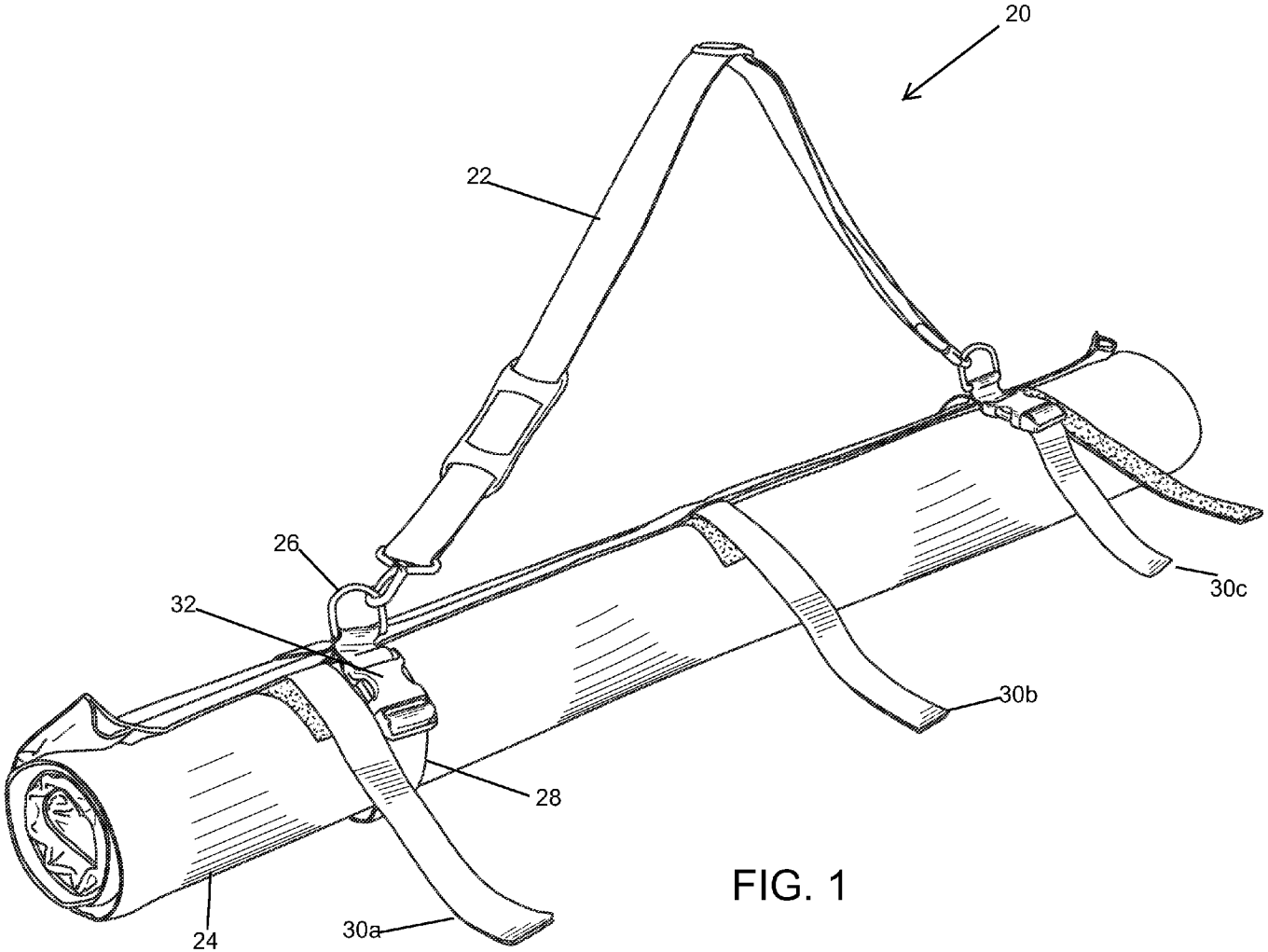
FIG. 1 shows a side perspective view of a portable display assembly of the present invention with the assembly folded-up in a transporting position.

Referring now to the drawings, FIG. 1 shows a portable display assembly 20 embodying the invention when the assembly is folded-up in a transporting position. The assembly 20 is complete for carrying with an adjustable shoulder strap 22 that may be removably attached to a pair of rings 26 affixed to a canvas display backdrop 24. While the backdrop 24 may be constructed from a variety of materials rigid enough to carry the weight of the stored material, canvas is preferred. The assembly when in the transporting position may kept in a tight and concise roll by three (3) hook and loop fastener systems, consisting of a pair of fasteners on opposing sides 30*a* and 30*c*, of the backdrop 24 and a hook and loop fastener system 30*b* in the middle part of the assembly, all of which wrap around the entire assembly 20. In addition to the fastener systems 30 there are a pair of locking straps 28 which encircle the assembly 20 and with snap locks 32, secure the assembly. The snap locks 32 are conventional luggage type locks.

Figure 2:
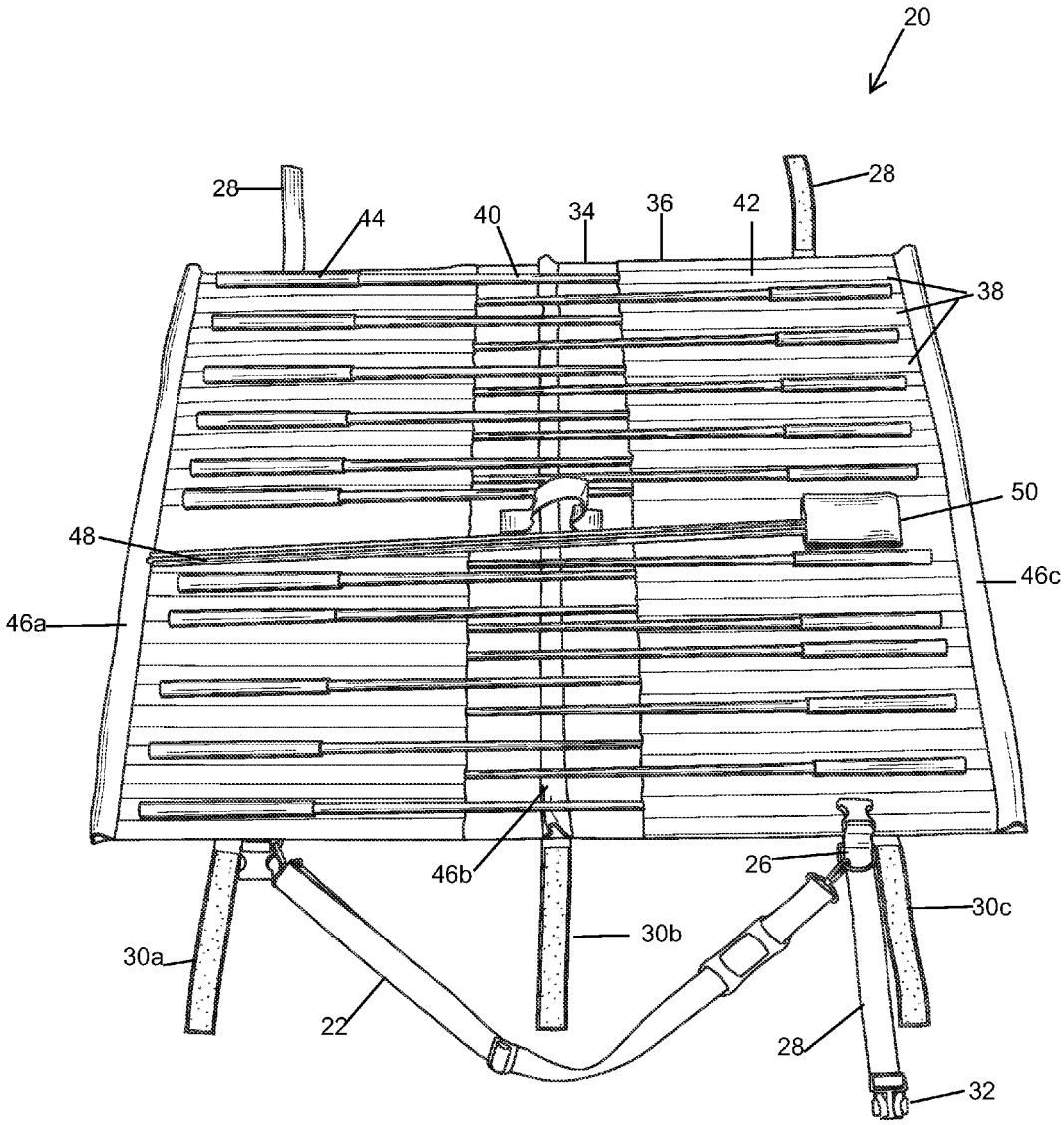
FIG. 2 shows a top perspective view of the display assembly with the assembly unraveled and spread wide open.
Figure 3:
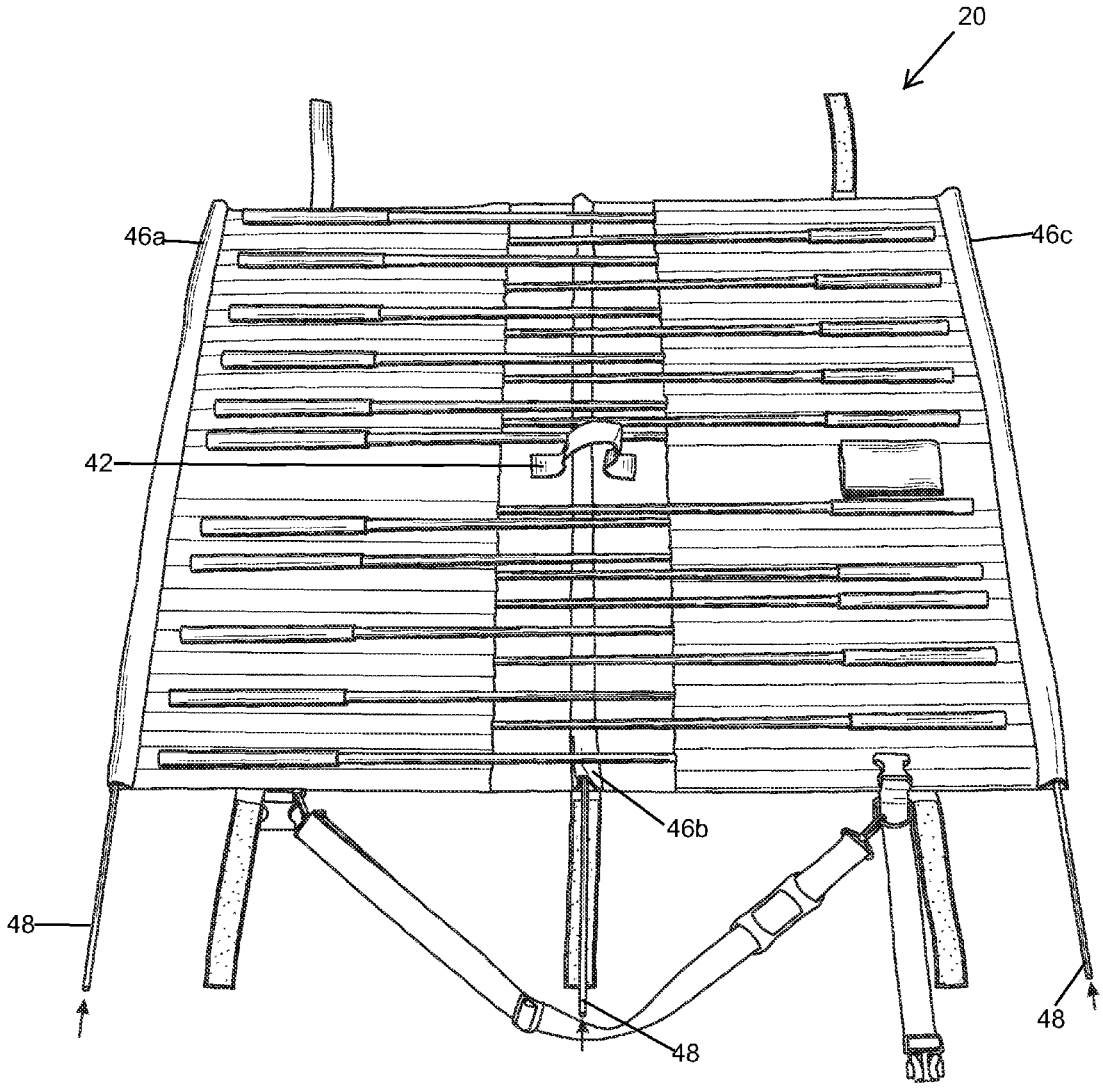
FIG. 3 shows a top perspective view of the display assembly with the instructions as to how support rods are inserted into the respective sleeves.

FIG. 2 depicts the assembly 20 when unraveled and prior to being put into the display position. The canvas display backdrop 24 has an outer canvas material 34 and an inner canvas material 36. The inner material 36 forms a series of aligned sleeves 38 when affixed to the outer material 34. Each sleeve 38 is of a size and shape to accommodate a distal end 42 of a golf club shaft 40 in a friction fit. The means for affixing the cloths can be by stitching or by using an industrial strength adhesive. The grip ends 44 of the shafts 40 are open for view, and they are arranged in an alternating sequence, which is critical for their providing of support for the display. A pair of elongated compartments 46*a* and 46*c* are defined along the edges on opposing sides of the canvas backdrop 24 as well as an elongated compartment 46*b* running along the middle of the canvas backdrop 24. Three rods 48 are secured within a pocket 50 when the assembly is transported. These rods may be of any substantial material such as metal, wood or plastic, but iron is the preferred choice of the Applicant.

Figure 4:
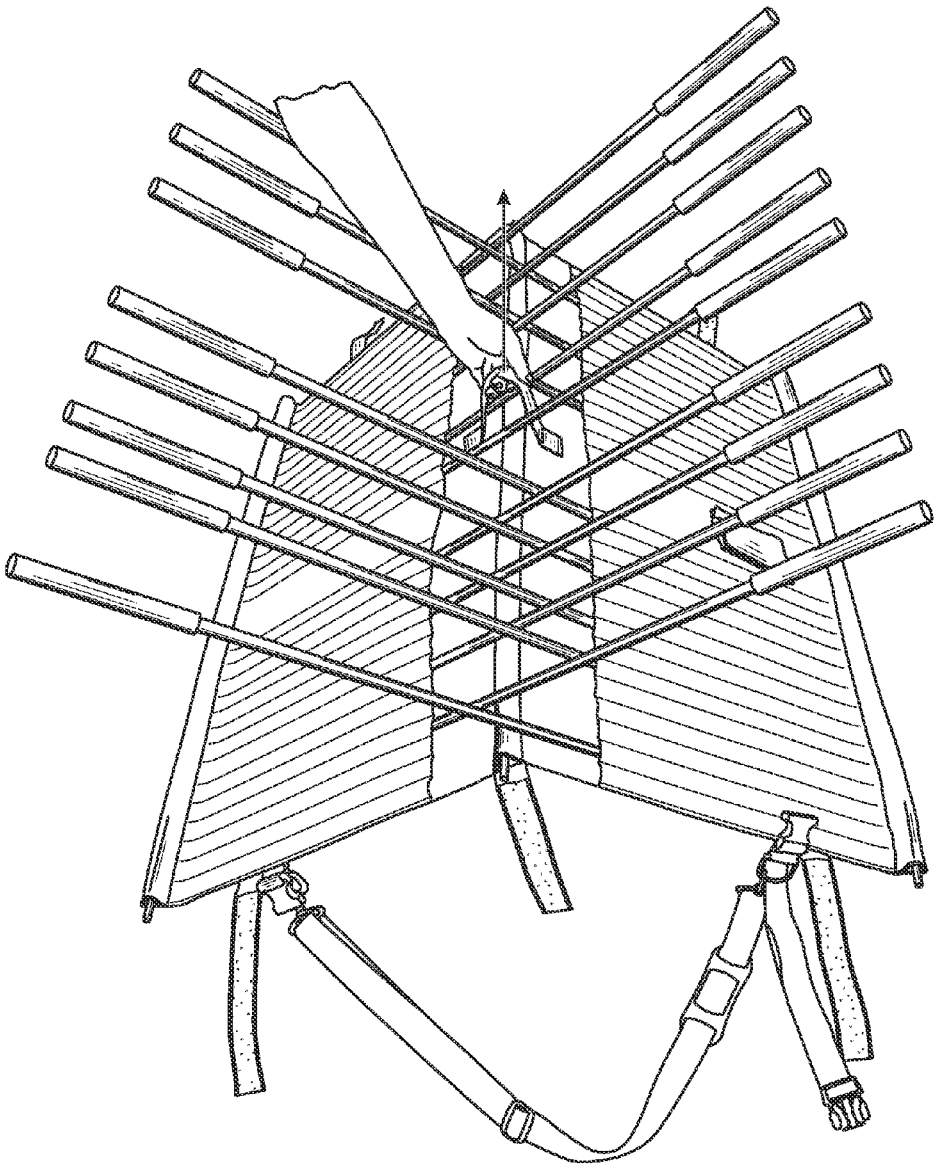
FIG. 4 shows a top perspective view of the handle being pulled-upward therein creating the assembly into a display rack.
Figure 5:
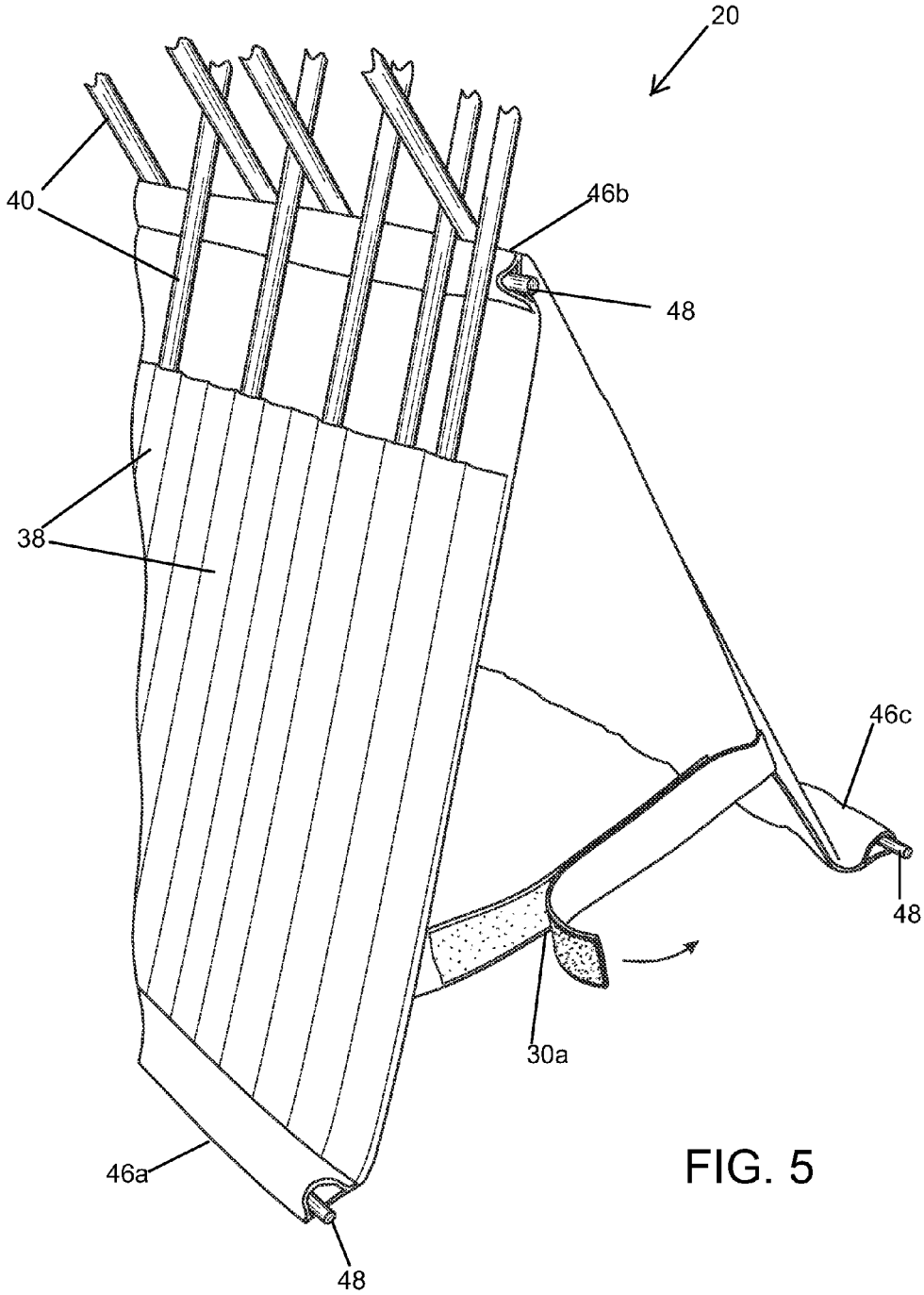
FIG. 5 shows a side perspective view of the hook and loop fastening system while being employed to secure the display.
Figure 6:
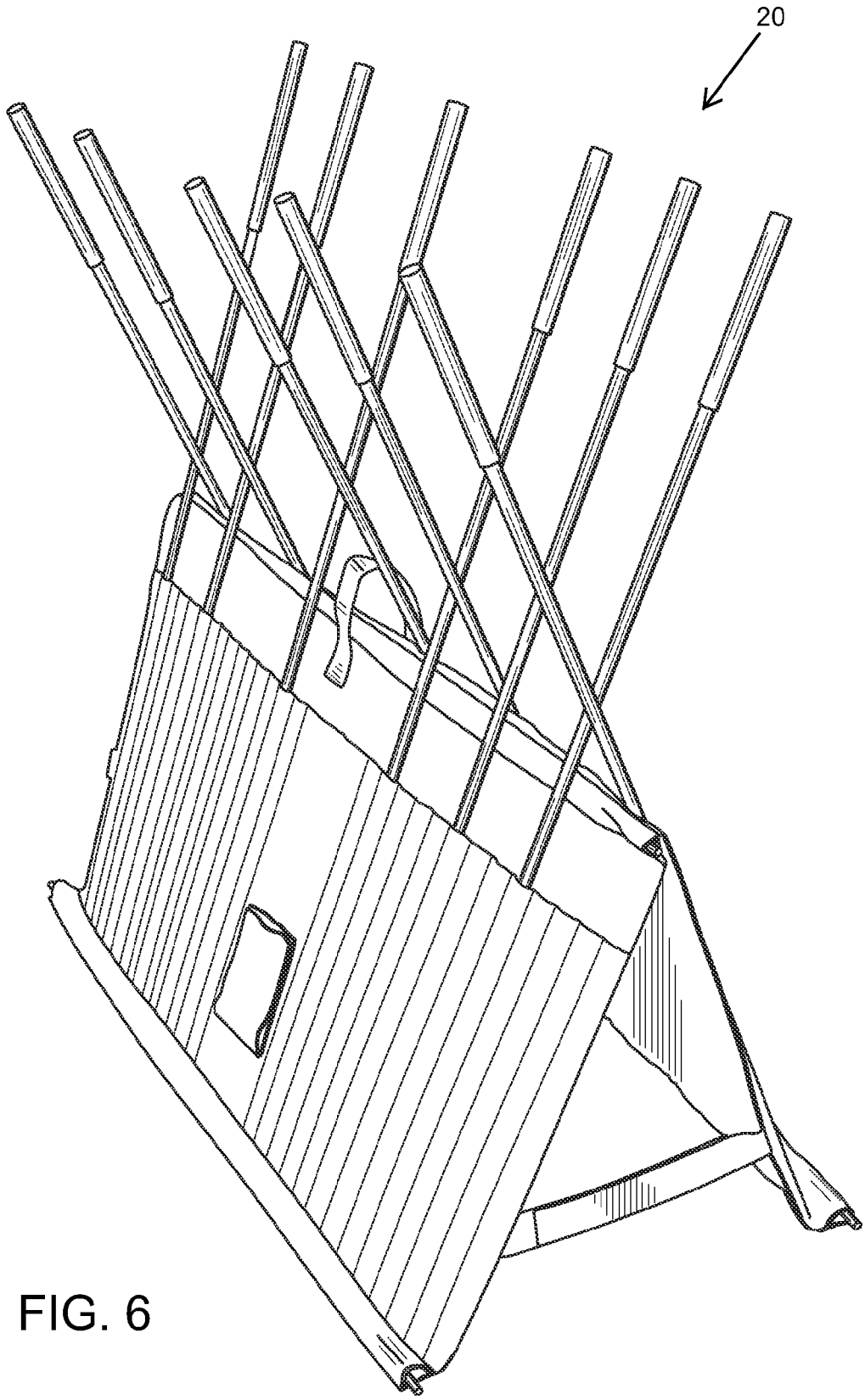
FIG. 6 shows the assembly in the full presentation mode.
Figure 7:
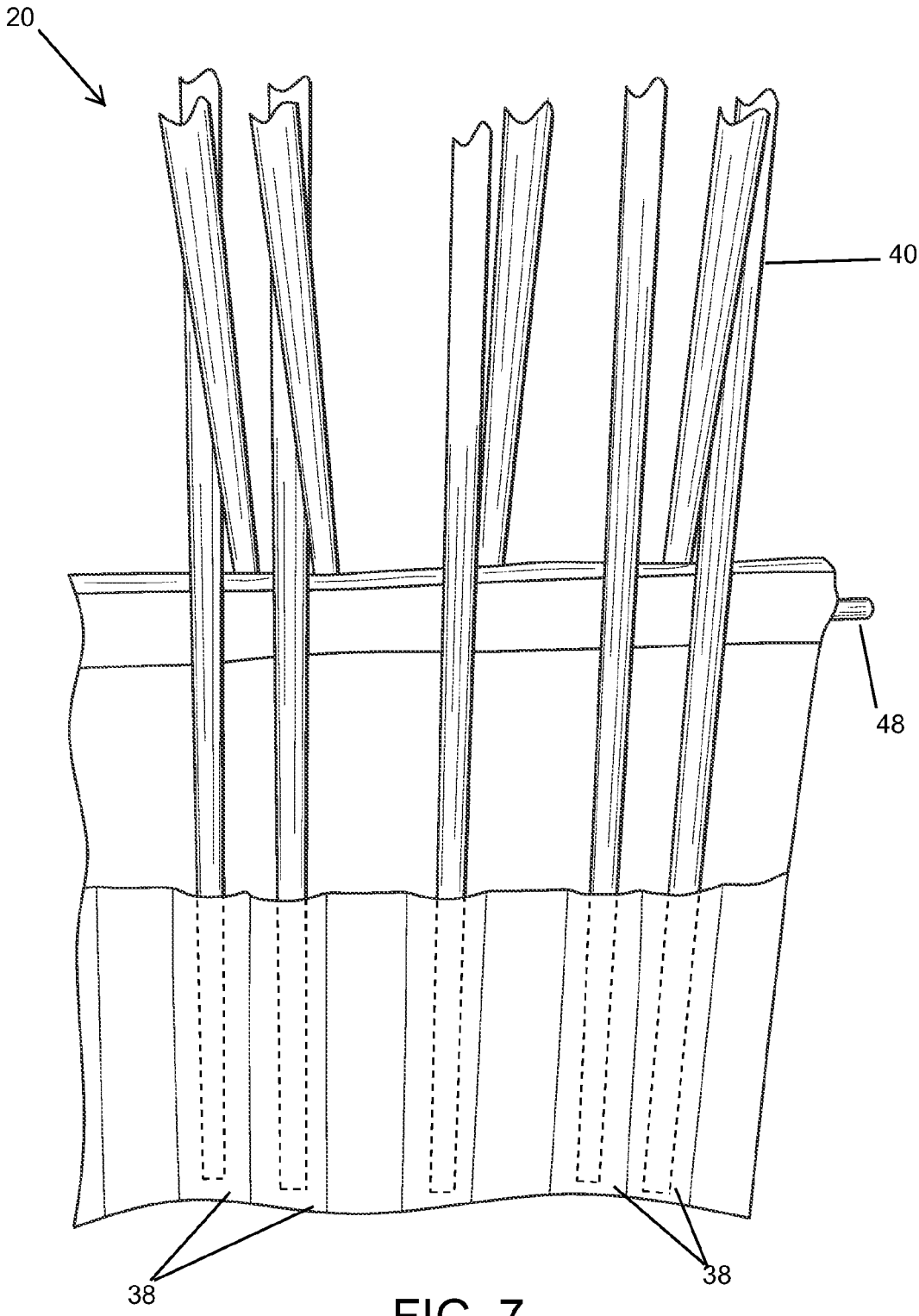
FIG. 7 shows a detailed side view of the manner of alignment of the golf club shaft sleeves.

FIGS. 3 to 6 show the assembly as it is transitioned into a free standing display rack. As best shown on FIG. 3, each one of the rods 48 is inserted into one of the ends of an elongated compartment 46*a*, 46*b*, or 46*c*. Once they are properly installed, then a user by grasping the handle grip 52 and by lifting it up as seen in FIG. 4, creates the display. When the display position is reached, the assembly 20 is self-supportable as its structural strength is provided by the golf club shafts 40, which is best illustrated in FIGS. 5 and 6. As an added measure of stability, the outer hook and loop fastening systems 30*a* and 30*c* (not shown) are fastened together. FIG. 7 shows the alternating sequencing of the shafts 40. To convert from a display position to a transportable position, and vice versa, only takes a minute or so.

It is to understood that the present is not limited to the embodiments described above, but encompasses any and all embodiments within the scope of the following claims

The invention claimed is:

1. A portable display assembly for use in displaying golf club shafts, the assembly comprising:

a canvas cloth backdrop comprising of outer and inner canvas cloths;

a plurality of aligned longitudinal sleeves created by means of attaching the inner canvas cloth to the outer canvas cloth;

a plurality of golf club shafts, each shaft having a grip end and a distal end, with each distal end extending into a corresponding sleeve, the sleeve of a size and shape to accept the shaft in a friction fit;

three rod compartments, two defined along opposing sides of the canvas backdrop and one defined along the middle of the backdrop and in a parallel relationship with the other two;

three thin rods, each rod capable of disposing in a corresponding rod compartment;

a handle on the inner side of the canvas cloth, wherein upon the handle being lifted upright, a coordinated movement of canvas cloth, rods, and golf club shafts is synchronized to form a free standing display.

2. The portable display assembly according to claim 1, wherein the attaching means for creating shaft sleeves comprises the inner cloth to be attached to the outer cloth is either by stitching or by an industrial strength adhesive.

3. The portable display assembly according to claim 1, wherein the inner side of the canvas backdrop contains a pocket for holding the rods in place when the display is broken down and in a portable state.

4. The portable display assembly according to claim 1, wherein the rods may be made of metal. wood or a hard plastic.

5. The portable display assembly according to claim 1, wherein the portable display assembly comprises a pair of locking straps which encircle and secure the assembly when the assembly is broken down for travel.

6. The portable display assembly according to claim 1, wherein the display comprises three hook and loop fastening systems, which wrap around the assembly and secure it when the assembly is broken down for travel.

7. The portable display assembly according to claim 6, wherein two of the hook and loop fastener systems are used to provide rigid support when the assembly is in the display mode.

8. The portable display assembly according to claim 1, wherein the canvas backdrop comprises a pair of rings and an adjustable shoulder strap for attaching to the rings.

9. A portable display assembly, comprising:

a canvas cloth backdrop;

a plurality of aligned longitudinal sleeves defined on an inner side of the backdrop;

a plurality of golf club shafts, each shaft having a distal end of a size and shape to friction-fit within a corresponding sleeve;

three elongated rods and three parallel elongated compartments defined in the backdrop, wherein each rod is friction fitted into one of the compartments to provide structure for a display; and a handle on the inner side of the canvas cloth, for lifting the assembly, wherein upon the handle being lifted upright, the assembly is coordinated into a free standing display of golf club shafts.

10. The portable display assembly according to claim 9, wherein the rods may be made of metal. wood or a hard plastic.

11. The portable display assembly according to claim 9, wherein the portable display assembly comprises a pair of locking straps which encircle and secure the assembly when the assembly is broken down for travel.

12. The portable display assembly according to claim 9, wherein the display comprises three hook and loop fastening systems, which wrap around the assembly and secure it when the assembly is broken down for travel.

13. The portable display assembly according to claim 12, wherein two of the hook and loop fastener systems are used to provide rigid support when the assembly is in the display mode.

14. The portable display assembly according to claim 9, wherein the canvas backdrop comprises a pair of rings and an adjustable shoulder strap for attaching to the rings.

* * * * *